US006019445A

United States Patent [19]

Gades

[11] Patent Number: 6,019,445

[45] Date of Patent: Feb. 1, 2000

[54] MULTIPLE COMPARTMENT LAUNDRY SORTER

[76] Inventor: Blair R. Gades, 1009 University Blvd., Mitchell, S. Dak. 57301

[21] Appl. No.: 09/231,754

[22] Filed: Jan. 15, 1999

[51] Int. Cl.[7] ..... A47B 81/00

[52] U.S. Cl. ..... 312/245; 312/290

[58] Field of Search ..... 312/245, 280, 312/290, 211, 212; 52/27, 39; 220/9.2, 9.3, 9.4, 909; 211/12, 85.15, 85.24; 248/99, 97

[56] References Cited

U.S. PATENT DOCUMENTS 4,585,283 4/1986 Redmon .
4,765,495 8/1988 Bisk ..... 211/181.1 X
4,966,310 10/1990 Hawkins ..... 220/9.2 X
4,979,705 12/1990 Bovitz .
5,102,208 4/1992 Joynes .
5,242,219 9/1993 Tomaka ..... 52/39 X
5,700,293 12/1997 Rydell ..... 312/245 X

*Primary Examiner*—Anthony Knight
*Assistant Examiner*—Karlena D Schwing
*Attorney, Agent, or Firm*—Moore & Hansen

[57] ABSTRACT

The multiple compartment laundry sorter of the present invention provides easy access to several storage areas, and the ability to position the unit in several locations. It preferably includes walls and dividers made of a material having an open mesh pattern to permit air circulation through the stored laundry items. The material is suspended from or attached to a frame that may be hung from a ceiling or wall. Alternatively, rollers or wheels may be attached to the frame for portable floor mounting.

14 Claims, 4 Drawing Sheets

MULTIPLE COMPARTMENT LAUNDRY SORTER

BACKGROUND OF THE INVENTION

1. Technical Field

The present invention relates generally to devices used to sort laundry prior to washing, especially such devices that have several compartments for different types of items to be laundered.

2. Background Information

Clothes hampers, used for the storage of soiled laundry, are very old and well known. More recently, others have developed devices for separating laundry of different types in different compartments. For example, colored laundry is separated from whites, or polyester from cotton.

However, a number of shortcomings have been found with these devices. For example, typical hampers have solid walls that restrict air flow on the sides and bottom, and frequently on the top as well. Thus, damp clothing items left in such a hamper are not likely to be exposed to the air, and may therefore attract mold and mildew, which may also affect other items in contact with the damp item.

Furthermore, typical hampers or clothes sorters are only accessible from one location, usually the top of the storage compartment. Such a limitation on accessibility is frequently very inconvenient, and also places limitations on where in a room the clothes hamper may be placed. In particular, the hamper will usually have to be placed on the floor, and floor space is frequently at a premium in the laundry areas of many residences.

The multiple compartment laundry sorter of the present invention overcomes difficulties described above and affords other features and advantages heretofore not available.

SUMMARY OF THE INVENTION

The multiple compartment laundry sorter of the present invention provides easy access to several storage areas, and the ability to position the unit in several locations. It preferably includes walls and dividers made of a material having an open mesh pattern to permit air circulation through the stored laundry items. The material is suspended from or attached to a frame that may be hung from a ceiling or wall. Alternatively, rollers or wheels may be attached to the frame for portable floor mounting.

It is an object of this invention to provide a laundry sorter for separating soiled laundry by various criteria, such as color, fabric or washing cycle, into a multiplicity of compartments. It is a further object of this invention to provide a laundry sorter that is easily accessible from at least two locations, providing access to each of the multiple compartments with equal ease and reliability. It is a further object of this invention that the material used to form the walls of the multiple compartments provide thorough ventilation to the contents thereof. This ventilation preferably is enhanced by the configuration of the compartments. It is a further object of this invention that the laundry sorter may be mounted in an elevated position for efficient use of the limited space available in the typical laundry room. Finally, it is also an object of this invention that the laundry sorter may be easily fabricated of readily available materials, rendering it inexpensive to manufacture and sell.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
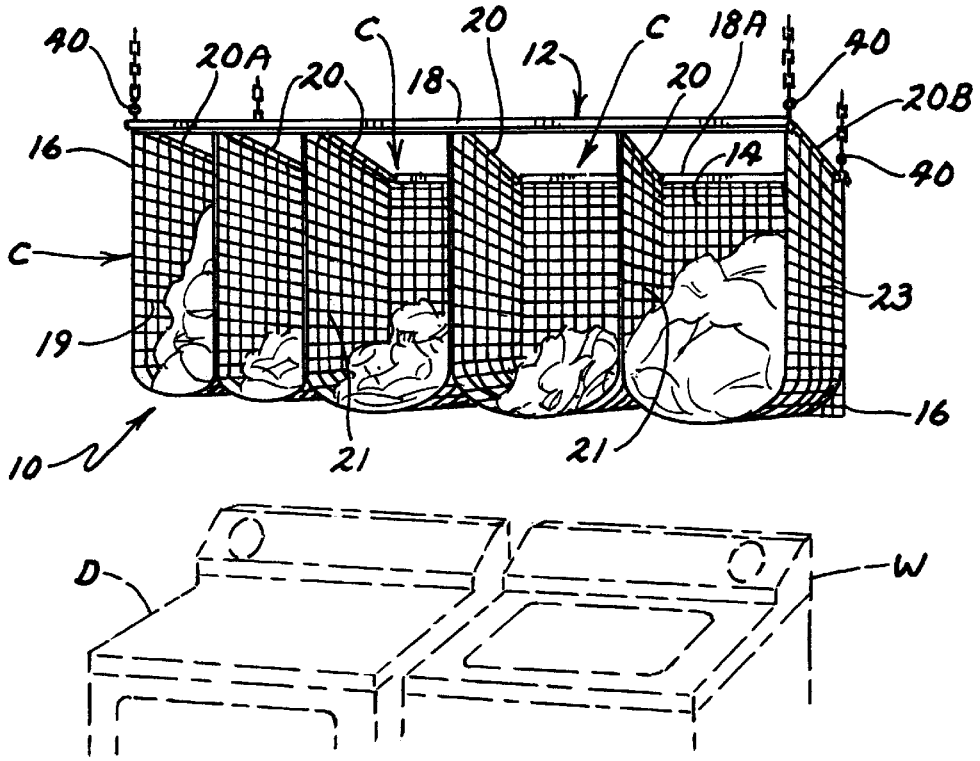
FIG. 1 is a front perspective view of a preferred embodiment of the multiple compartment laundry sorter of the present invention.

With reference to the drawings, and in particular to FIG. 1, the multiple compartment laundry sorter is generally indicated by reference numeral 10. Laundry sorter 10 includes a support frame 12 and a rear wall 14. Preferably, a sheet of plastic mesh 16 or other perforated material is used to divide the multiple compartments C. A sheet of plastic mesh 16 or other perforated material is also used for the rear wall 14. As may be seen in FIGS. 1 and 2, compartments C may vary in width, although their depth will generally remain constant, preferably the width of a sheet of plastic mesh 16.

Figure 2:
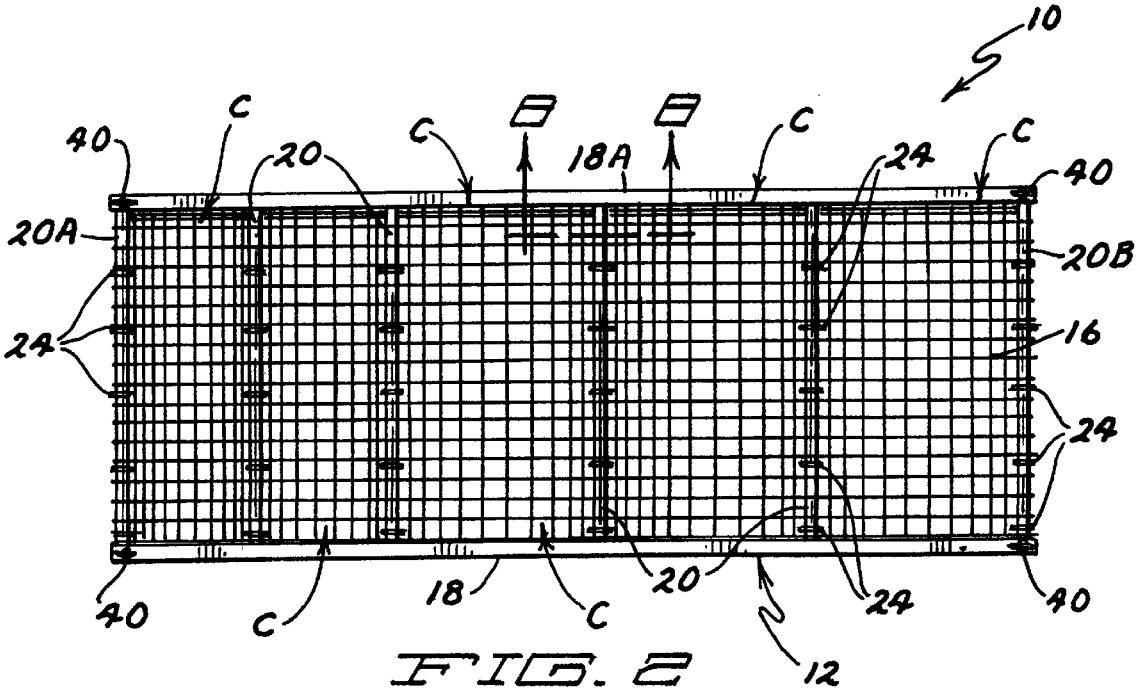
FIG. 2 is a top view of the multiple compartment laundry sorter.
Figure 7:
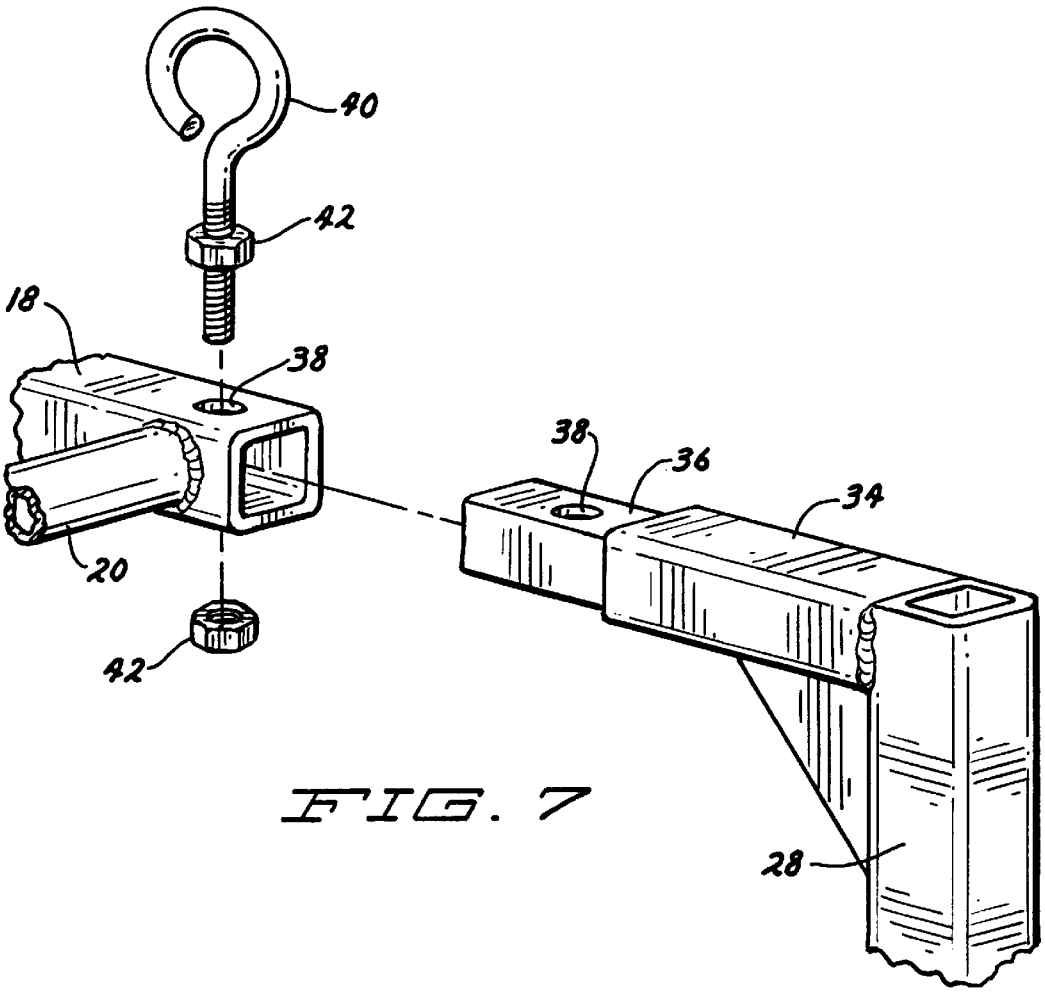
FIG. 7 is an exploded perspective view of the frame of the multiple compartment laundry sorter.
Figure 8:
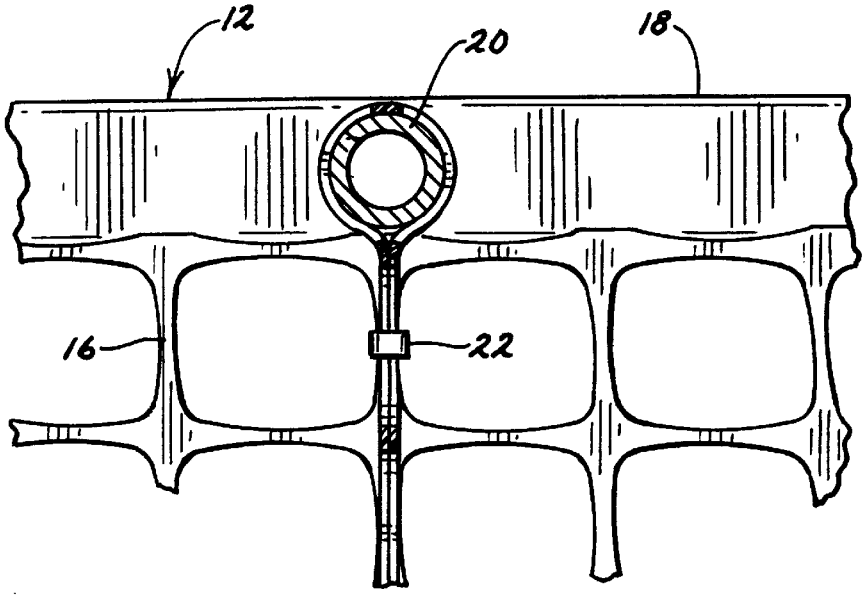
FIG. 8 is a section view of the frame of the multiple compartment laundry sorter taken along line 8—8 of FIG. 2.

Referring to FIGS. 2, 7 and 8, support frame 12 preferably includes square tubing sections 18 and 18A along the front and rear sides, respectively, of laundry sorter 10. Tubing section 18A defines the top side of rear wall 14. Extending between tubing sections 18 and preferably welded thereto are round lateral tubing sections 20, 20A and 20B. Tubing sections 20 define the top sides of intermediate wall members 21, and tubing sections 20A and 20B define the top sides of end wall members 19 and 23, respectively. Square tubing sections 18, 18A and round tubing sections 20, 20A and 20B are preferably metal, but may alternatively be made of plastic or wood. The bottoms of compartments C are defined by a floor wall member 25. In the preferred embodiment, floor wall member 25 is simply the lower portion of plastic mesh 16 suspended from tubing sections 20, 20A and 20B. As shown in FIG. 8, a single long sheet of plastic mesh 16 is preferably used to form the dividing and supporting surfaces of the multiple compartments C. The sheet of plastic mesh 16 is wound over lateral support tubes 20, and generally retained in position by retaining ties 22, which interlock with mesh 16 of rear wall 14. Retaining ties 22 preferably are commonly available wire ties. As shown in FIG. 2, the sheet of plastic mesh 16 is attached to lateral tubing sections 20 with retaining clips 24. Retaining clips 24 preferably are commonly available ratchet-type pinch clips. Retaining clips 24 preferably are spaced along lateral tubing sections 20 approximately every four to six inches.

Figure 4:
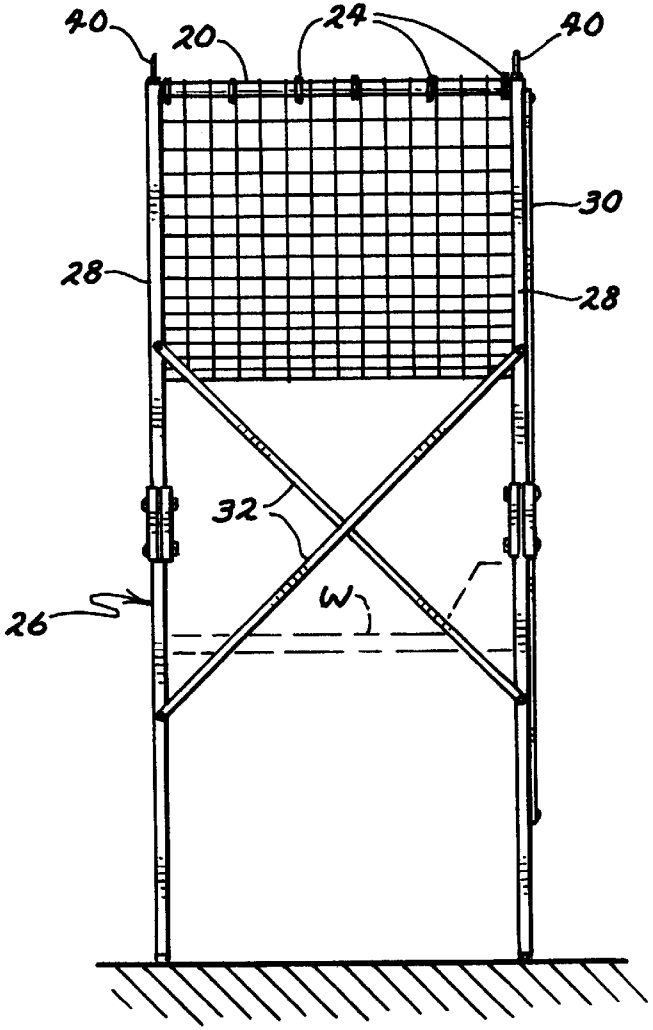
FIG. 4 is a right side view of the multiple compartment laundry sorter illustrated in FIG. 3.
Figure 3:
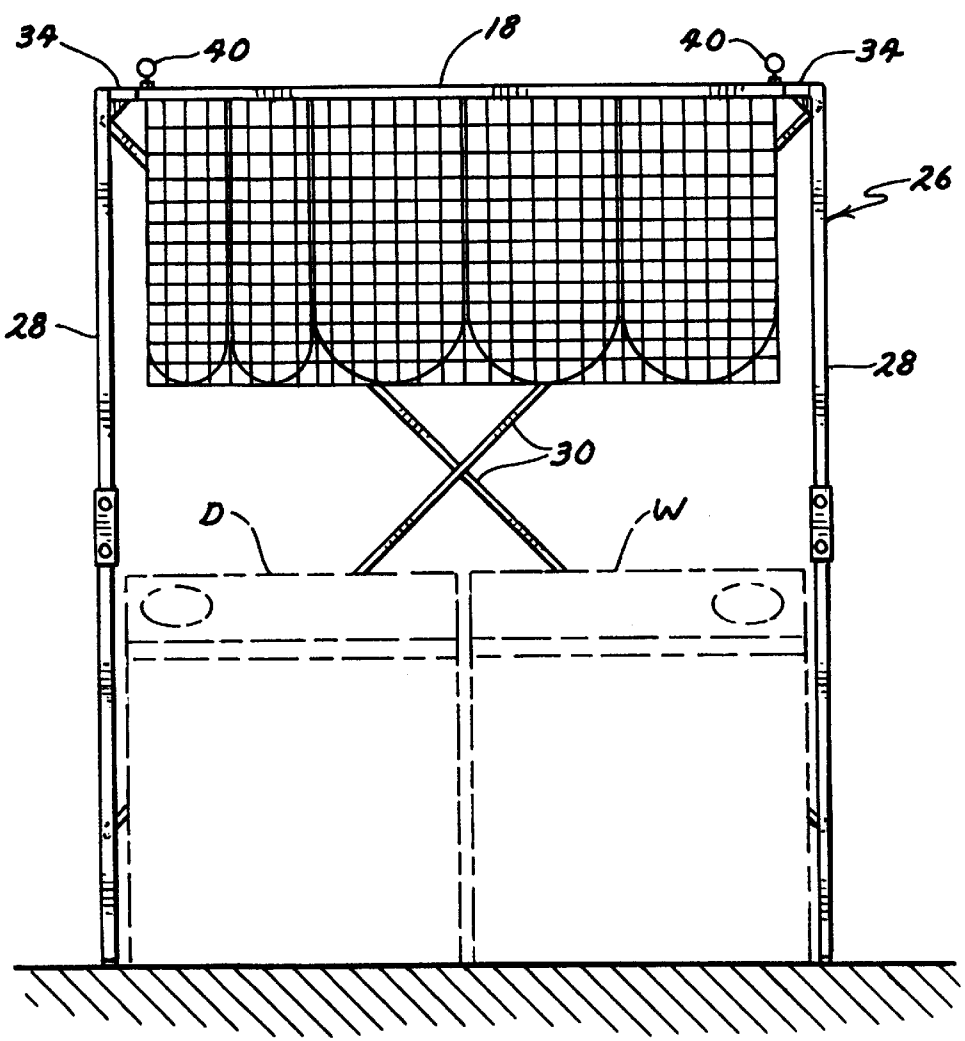
FIG. 3 is a front view of a second embodiment of the multiple compartment laundry sorter.

As shown in FIG. 1 the basic configuration of laundry sorter 10 may be easily adapted to be suspended from a ceiling, as over a clothes washing machine W and dryer D. Alternatively, as shown in FIGS. 3 and 4, the addition of a support stand 26 to laundry sorter 10 permits positioning over clothes washing machine W and dryer D. Support stand 26 preferably includes legs 28, rear cross bracing 30 and side cross bracing 32. As shown in FIG. 7, support stand 26 may be attached to support frame 12 of the suspended embodiment illustrated in FIG. 1. To do so, an adaptor 34 is fixedly attached as by welding to the upper end of leg 28. Adaptor 34 includes a reduced portion 36 that may be slidably received within the open end of tubing section 18. Tubing section 18 and reduced portion 36 of adaptor 34 each include holes 38 that may be aligned for receiving a threaded eye bolt 40, which may be fixed in position with nuts 42. For added support, a strengthening flange 44 is preferably fixedly attached, as by welding, to the intersection of leg 28 and adaptor 34. In the embodiment illustrated in FIGS. 3 and 4, regular hex-head bolts may be substituted for eye bolts 40 if laundry sorter 10 will not be suspended from a ceiling as illustrated in FIG. 1.

Figure 5:
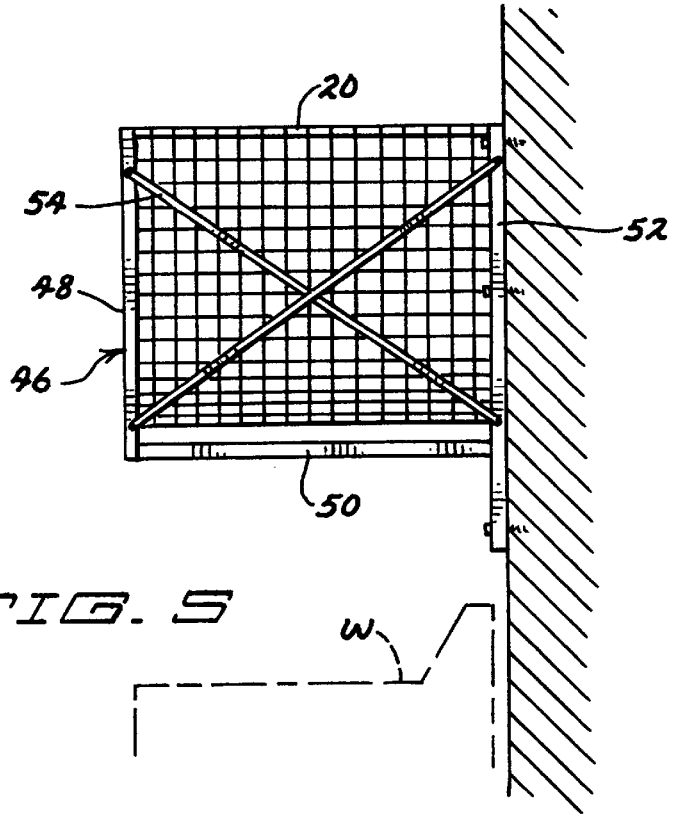
FIG. 5 is a right side view of a third embodiment of the multiple compartment laundry sorter.

As shown in FIG. 5, a mounting frame 46 may alternatively be attached to laundry sorter 10 for attachment to a wall. Mounting frame 46 includes front vertical support members 48, lower horizontal support members 50, rear vertical mounting members 52 and side cross bracing 54. Front and rear vertical mounting members 48, 52, respectively, attach to square tubing sections 18 in the same fashion as illustrated in FIG. 7.

Figure 6:
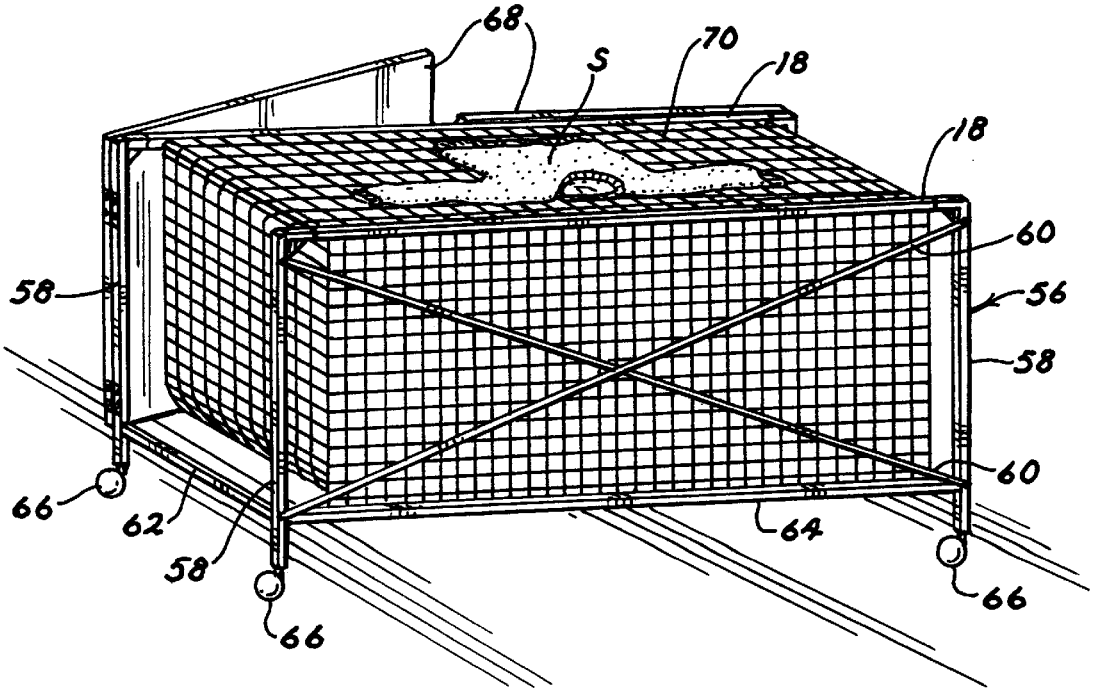
FIG. 6 is a rear perspective view of a fourth embodiment of the multiple compartment laundry sorter.

Finally, as shown in FIG. 6, another alternative arrangement of laundry sorter 10 includes the addition of a rolling frame 56 for easy moving on a floor or other flat surface. Rolling frame 56 includes four legs 58, rear cross bracing 60, left and right lower horizontal support members 62, and front and rear lower horizontal support members 64. Attached to the bottom of each leg 58 is a roller 66. Preferably, the embodiment of laundry sorter 10 illustrated in FIG. 6 also includes front doors 68 and an upper horizontal surface 70, also made of plastic mesh 16. As shown in FIG. 6, upper horizontal surface 70 may be used for conveniently drying and storing certain delicate laundry items, such as sweater S.

Referring to FIGS. 1 and 2, while the preferred embodiment is made of flexible plastic mesh 16, it is readily apparent that rigid, perforated plastic materials may be directly substituted for the described components and still fall within the spirit and scope of the invention.

The multiple compartments C may be effectively utilized for sorting and storing different items of laundry. For example, the three relatively large compartments C as shown on the right hand side of the laundry sorter in FIG. 1 may be utilized to receive, respectively, dark clothing items, light colored clothing items, and towels. The two smaller width compartments C shown on the left hand side of the sorter apparatus of FIG. 1 could be utilized, for example, to store red and green colored clothing items, respectively. Additionally, sub-compartments C-1 and C-2 could be formed at the upper end of the two small compartments as shown in the elevation view of FIG. 3. In that embodiment, the sub-compartments C-1 and C-2 are simply formed by providing separate, mesh bottom walls 27 which are attached to the side walls of mesh material 16 defining the two small end compartments. Alternatively, such shorter height sub-compartments could be formed by simply hanging separate mesh fabric material inside of the mesh 16 side walls already in place and suspended from the support bars or tubing sections 20, 20A and 20B. The relatively short height sub-compartments C-1 and C-2 could be advantageously used for sorting and receiving extreme Delicates, such as items of women's underclothing, sweaters and special blouses which might be made of silk or rayon.

While the preferred embodiments of the invention have been described, it should be understood that various changes, adaptations and modifications may be made therein without departing from the spirit of the invention and the scope of the appended claims.

What is claimed is:

1. A laundry sorter, comprising:

a support frame having a front support member and a rear support member, each said support member having a first end and a second end, a first lateral support member extending between and attached to said first ends of said front and rear support members, and a second lateral support member extending between and attached to said second ends of said front and rear support members, said support frame having a front side, a rear side, a left side and a right side, said front support member positioned on said front side thereof and said rear support member positioned on said rear side thereof;

a plurality of intermediate lateral support members extending between and attached to said front support member and said rear support member and positioned between said first and second lateral support members; and a first flexible fabric portion extending between and attached to said first and second lateral support members, the length of said flexible fabric portion being substantially longer than the distance between said first and second lateral support members, said flexible fabric portion overlying each of said plurality of intermediate lateral support members and forming intermediate storage portions between each of said lateral support members.

2. The laundry sorter described in claim 1, further comprising:

a rear wall portion suspended from said rear support member of said support frame.

3. The laundry sorter described in claim 2, wherein said rear wall portion comprises a second flexible fabric portion.

4. The laundry sorter described in claim 1, further comprising:

a support stand cooperative with said support frame, said support stand having first, second, third and fourth leg members and integral brace members for maintaining said leg members in relative position relative one to another, said support stand having a front side and a rear side, said front side of said support stand being adjacent said front side of said support frame and said rear side of said support stand being adjacent said rear side of said support frame, said front side of said support stand extending between said first and second leg members and said rear side of said support stand extending between said third and fourth leg members, said integral brace members being located on at least said rear side of said support stand.

5. The laundry sorter described in claim 4, further comprising:

rolling members attachable to said leg members of said support frame.

6. The laundry sorter described in claim 4, further comprising:

closure means on said front side of said support frame.

7. The laundry sorter described in claim 6, wherein said closure means comprises:

first and second door members, said first door member being pivotally attachable to said first leg of said support stand and said second door member being pivotally attachable to said second leg of said support stand.

8. The laundry sorter described in claim 4, further comprising:

an upper wall portion extending horizontally over said storage portions, said upper wall portion attached to and extending between said first and second lateral support members of said support frame.

9. The laundry sorter described in claim 1, further comprising:

suspension means for suspending said support frame from a support structure above the laundry sorter.

10. The laundry sorter described in claim 9, wherein said suspension means comprises:

eye bolts attachable to said first and second ends of said front and rear support members of said support frame.

11. The laundry sorter described in claim 1, further comprising:

mounting means for mounting the laundry sorter to a vertical support structure.

12. The laundry sorter described in claim 11, wherein said mounting means comprises:

first and second vertical mounting members, said first vertical mounting member being attached to and downwardly depending from said first end of said rear support member, and said second vertical mounting member being attached to and downwardly depending from said second end of said rear support member;

first and second front vertical support members, said first front vertical support member being attached to and downwardly depending from said first end of said front support member, and said second front vertical support member being attached to and downwardly depending from said second end of said front support member; and first and second lower horizontal support members, said first lower horizontal support member extending between said first vertical mounting member and said first front vertical support member, and said second lower horizontal support member extending between said second vertical mounting member and said second front vertical support member.

13. A laundry sorter for use in a laundry room or other location having at least one suspension surface to which the laundry sorter may be attached, comprising:

a support frame including a first lateral support member, a second lateral support member and an intermediate lateral support member for supporting a plurality of perforated wall members defining a plurality of compartments, said support frame having top, bottom, front, rear, left and right sides, said perforated wall members including a generally vertically disposed first perforated end wall member having top, bottom, front and rear sides, said first perforated end wall member defining said left side of said support frame, a generally vertically disposed second perforated end wall member having top, bottom, front and rear sides, said second perforated end wall member defining said right side of said support frame, said second perforated end wall member being generally coplanar with said first perforated end wall member, a generally vertically disposed rear perforated wall member having top, bottom, front and rear sides, said rear perforated wall member extending between and generally perpendicular to said rear sides of said first and second perforated end wall members, said rear perforated wall member defining said rear side of said support frame, and at least one generally vertically disposed intermediate perforated wall member having top, bottom, front and rear sides, said intermediate perforated wall member being generally coplanar with and disposed between said first and second perforated end wall members, said intermediate perforated wall members defining a plurality of compartments for storing soiled laundry;

a generally horizontally disposed perforated floor wall member extending between and generally perpendicular to said bottom sides of said first and second perforated end wall members;

means for attaching said support frame to the suspension surface, whereby said compartments are accessible from said top and front sides of said support frame, and all sides of said compartments are bordered by perforated surfaces, permitting circulation of air through said compartments; and first flexible portion extending between and attached to said first and second lateral support members, said flexible fabric portion overlying the intermediate lateral support member.

14. The laundry sorter described in claim 13, wherein said means for attaching said support frame to the suspension surface comprise:

eye bolts attachable to said top sides of said first and second perforated end wall members, whereby said support frame may be suspended from a suspension surface such as a ceiling.

* * * * *